US005329663A

United States Patent [19]

Council

[11] Patent Number: 5,329,663

[45] Date of Patent: Jul. 19, 1994

[54] MULTIPLE ANGLE PAINT BRUSH HOLDER

[76] Inventor: Laura Council, Rte. 5, Box 21H, Wills Point, Tex. 75169

[21] Appl. No.: 63,606

[22] Filed: May 19, 1993

[51] Int. Cl.[5] ..... A46B 5/00

[52] U.S. Cl. ..... 15/143.1; 15/145; 15/146; 15/176.6

[58] Field of Search ..... 15/106, 143.1, 144.1, 15/145, 146, 172, 176.1, 176.6; 285/155; 403/169, 300, 305, 403

[56] References Cited

U.S. PATENT DOCUMENTS

| | | | |
|---|---|---|---|
| 467,046 | 1/1892 | Myers | 15/146 |
| 854,020 | 5/1907 | Bossert | 285/155 |
| 1,117,778 | 11/1914 | Brown | 15/146 |
| 3,994,037 | 11/1976 | Sims | 15/146 |
| 4,157,598 | 6/1979 | Talent | 15/146 |
| 4,715,080 | 12/1987 | Rydzicki | 15/172 |

FOREIGN PATENT DOCUMENTS

| | | | |
|---|---|---|---|
| 4009 | 12/1900 | Austria | 15/146 |
| 1044925 | 6/1953 | France | 15/146 |
| 0578830 | 7/1958 | Italy | 15/176.1 |

*Primary Examiner*—Timothy F. Simone
*Assistant Examiner*—Randall E. Chin
*Attorney, Agent, or Firm*—Michael A. O'Neil

[57] ABSTRACT

A paint brush holder having a threaded opening for receiving a standard threaded extension rod of any desired length. The paint brush holder further includes a unique handle clamp for securely retaining the handle of the paint brush at multiple angles with respect to the received extension rod. By securing the paint brush at the desired angle and attaching the extension rod, a painter is able to access and paint, in a controlled manner, high, hard to reach painting locations such as ceiling corners, edges, moldings and trim.

11 Claims, 4 Drawing Sheets

MULTIPLE ANGLE PAINT BRUSH HOLDER

TECHNICAL FIELD

The present invention relates to painting tools and, in particular, to an apparatus for extending and holding a paint brush at multiple angles.

BACKGROUND OF THE INVENTION

The safest location for a painter is on the ground. Unfortunately, both professional and amateur painters are often called upon to paint high, hard to reach places, such as ceilings or eaves, that are not readily accessible to painters of average height. The use of a ladder is (and has been) the preferred method for facilitating painter access to such difficult and potentially dangerous locations.

It is well known that the use of ladders presents a certain danger of injury to the painter most often caused by a fall. Most such ladder related injuries are directly traced to misuse of the ladder (for example, by placing the ladder on uneven ground or by standing on the top step). In other cases, the painter is accidentally injured while properly using the ladder (for example, by tripping or slipping on the ladder while painting or climbing).

In response to the danger of injury presented by the use of ladders it is commonplace for painters to utilize extension rods, most often in conjunction with paint rollers, to paint high locations such as ceilings and eaves without having to climb a ladder. While adequately painting open, flat locations, paint rollers are not the preferred tool for painting high, delicate or hard to reach places, such as corners, edges, moldings and trim, where controlled paint application is required to achieve satisfactory results. Thus, the painter must still make use of a ladder and a paint brush to finish the painting job.

Accordingly, there is a need for an apparatus that will facilitate the use of a paint brush or other painting apparatus by a painter to access and paint, in a controlled manner, high, hard to reach places such as ceiling corners, edges, moldings and trim.

SUMMARY OF THE INVENTION

The present invention addresses the foregoing problems associated with the painting of high, hard to reach places, such as ceiling corners, edges, moldings and trim. The apparatus of the present invention comprises a paint brush holder having a threaded opening at one end for receiving a standard threaded extension rod of any desired length. Attachment of the extension rod enables the painter to reach painting heights normally accessible only from a ladder.

The paint brush holder further includes a unique handle clamp for securely retaining the handle of the paint brush or other painting apparatus at multiple angles with respect to the received extension rod. In a first position, the handle clamp secures the handle of the paint brush in an orientation parallel to the extension rod to paint a desired surface. A second position of the handle clamp angles the paint brush away from the received extension rod to paint another desired surface. The multiple angle clamp thus allows the painter to secure the paint brush at an angle with respect to the extension rod that facilitates controlled painting of high areas.

BRIEF DESCRIPTION OF THE DRAWINGS

A more complete understanding of the invention may be had by reference to the following Detailed Description when taken in conjunction with the accompanying Drawings wherein.

DETAILED DESCRIPTION OF THE INVENTION

Figure 1:
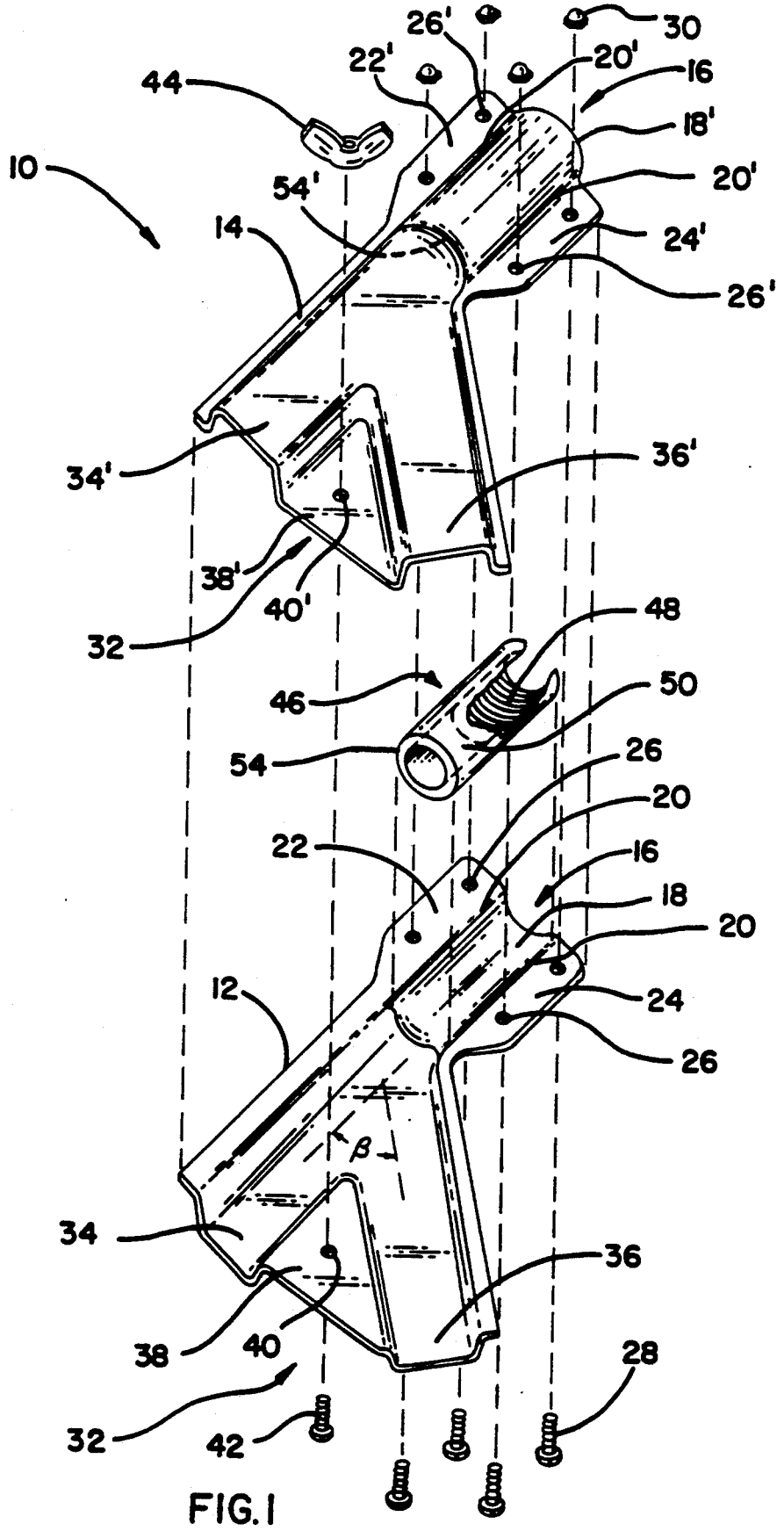
FIG. 1 is an exploded perspective view of the multiple angle paint brush holder of the present invention.

Referring now to FIG. 1, there is shown an exploded perspective view of the multiple angle paint brush holder 10 of the present invention comprising mirror image, bottom and top members 12 and 14, respectively. The members 12 and 14 are preferably integrally formed through use of a molding, shaping or other suitable fabrication process. The members 12 and 14 are comprised of a malleable or moldable material such as aluminum or plastic. It will, of course, be understood that any other material having similar performance and fabrication qualities may be utilized in constructing the members 12 and 14.

The bottom member 12 includes a first end 16 having formed therein a semi-circular shaped channel 18. Extending outwardly from the top edges 20 of the semi-circular shaped channel 18 are flanges 22 and 24. Each flange 22 and 24 includes two openings 26 adapted for insertion therethrough of a bolt 28 or other securing means of choice. The bolt 28, in conjunction with a corresponding nut 30, permanently secures the member 12 to the member 14 at the first end 16 as is more easily seen with reference to FIG. 2.

Returning to FIG. 1, the bottom member 12 further includes a second end 32, opposed from the first end 16, having formed therein a pair of generally "U" shaped channels 34 and 36. The first "U" shaped channel 34 is oriented parallel to and aligned with the semi-circular shaped channel 18 at the first end 16. The second "U" shaped channel 36 is angled away from and oriented at an acute angel $\beta$ with respect to the first "U" shaped channel 34. The angle $\beta$ is preferably forty-five degrees, but the second channel 36 may be formed in the second end 32 and oriented at any desired angle that will facilitate the painting process as will be described.

Extending between the first and second "U" shaped channels 34 and 36, respectively, is a web 38 including an opening 40 adapted for insertion therethrough of a bolt 42 or other securing means of choice. The bolt 42, in conjunction with a corresponding wing nut 44, releasably secures the member 12 to the member 14 at the second end 32 as is more easily seen with reference to FIG. 2.

As mentioned above the members 12 and 14 are mirror images of each other. Accordingly, the top member 14 includes the same elements as described above with respect to the bottom member 12. The corresponding elements in the top member 14 are designated by an identical reference numeral as in FIG. 1 and are distinguished from the elements in the bottom member 12 by the prime (') designation.

The multiple angle paint brush holder 10 further includes a cylindrical member 46 shown in a broken perspective view in FIG. 1. The cylindrical member 46, like the members 12 and 14, is also preferably integrally formed through use of a molding, shaping or other suitable fabrication process. Preferably, the cylindrical member 46 is comprised of a malleable or moldable material such as aluminum or plastic. The cylindrical member 46 includes an interior and exterior surface 48 and 50, respectively. The interior surface 48 of member 46 is threaded to matingly receive a correspondingly threaded extension rod (not shown, see FIGS. 3 and 4) of any desired length. The exterior surface 50 of the member 46 is a relatively smooth surface defined by an outer surface radius that substantially matches the inner surface radius of the semi-circular shaped channels 18 and 18' of the members 12 and 14, respectively.

Figure 2:
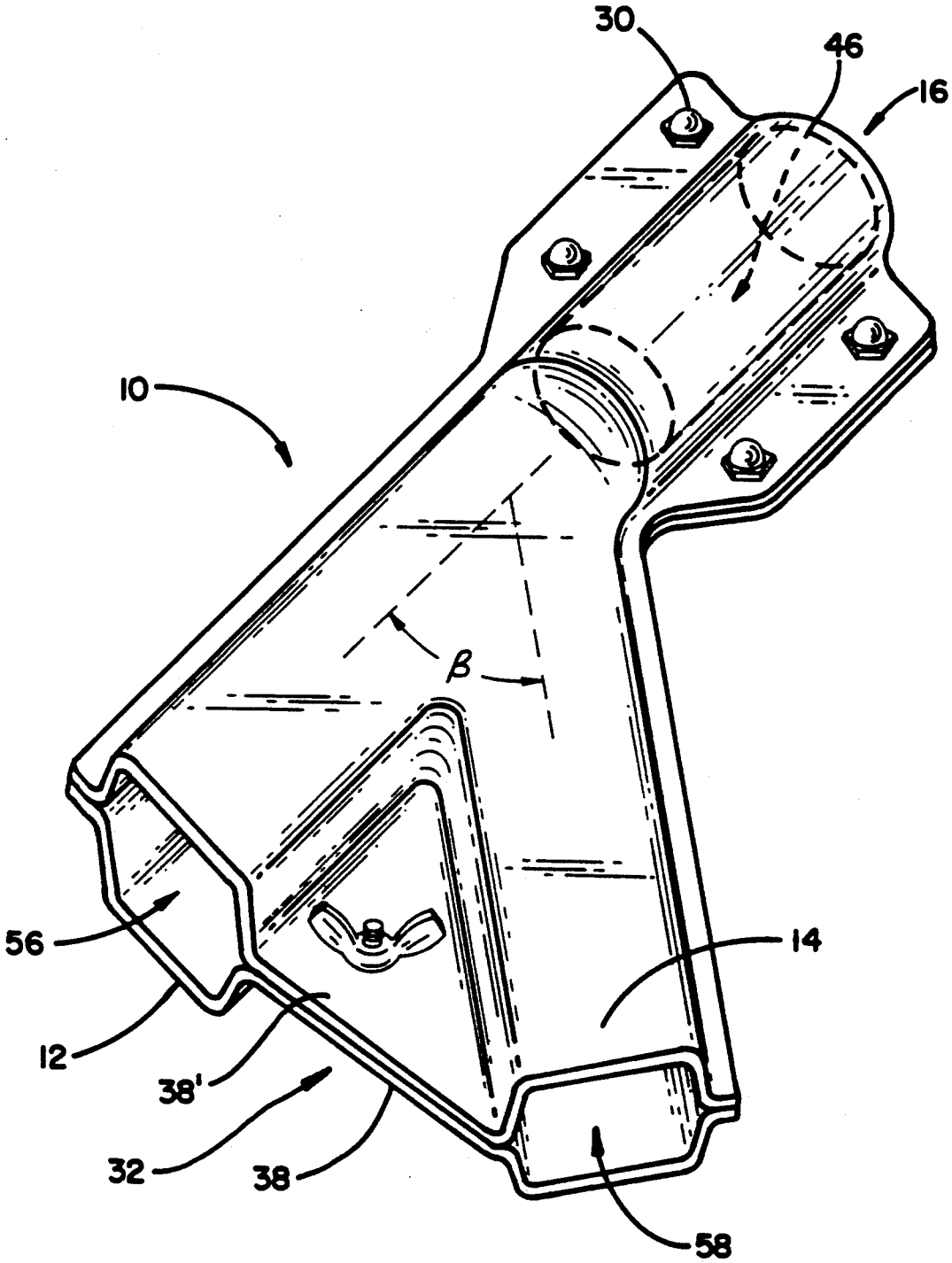
FIG. 2 is an assembled perspective view of the multiple angle paint brush holder of the present invention.

Reference is now made to FIGS. 1 and 2, wherein FIG. 2 shows an assembled perspective view of the multiple angle paint brush holder 10 of the present invention. Cylindrical member 46 is positioned between members 12 and 14 in the semi-circular shaped channels 18 and 18'. The bolts 28, in conjunction with corresponding nuts 30, permanently secure the member 12 to the member 14 at the first end 16. As the outer surface radius of the cylindrical member 46 substantially matches the inner surface radius of the semi-circular shaped channels 18 and 18', the friction forces exerted between the top, bottom and cylindrical members following assembly of the first end 16 will function to secure and retain the cylindrical member within the first end of the multiple angle paint brush holder 10.

Alignment of the first "U" shaped channels 34 and 34' of the mirror image bottom and top members 12 and 14, respectively, forms an opening for a first brush handle clamp 56 at the second end 32. Alignment of the second "U" shaped channels 36 and 36' of the mirror image bottom and top members 12 and 14, respectively, forms an opening for a second brush handle clamp 58 at the second end 32. The second clamp 58 is angled away from and oriented at an acute angle $\beta$ with respect to the first clamp 56. When the wing nut 44 is tightened, webs 38 and 38' are drawn together (as shown in FIG. 2) causing the first and second brush handle clamps 56 and 58 to tighten around the handle of any paint brush inserted therein, thus securing the paint brush within the holder 10 by means of friction force. When the wing nut 44 is untightened, the webs 38 and 38' move apart, the clamps 56 and 58 release, and the paint brush may be removed. It will, of course, be understood that the clamps 56 and 58 will retain any handled painting instrument desired, such as, mini-rollers, sponge brushes, etc.

Figure 3:
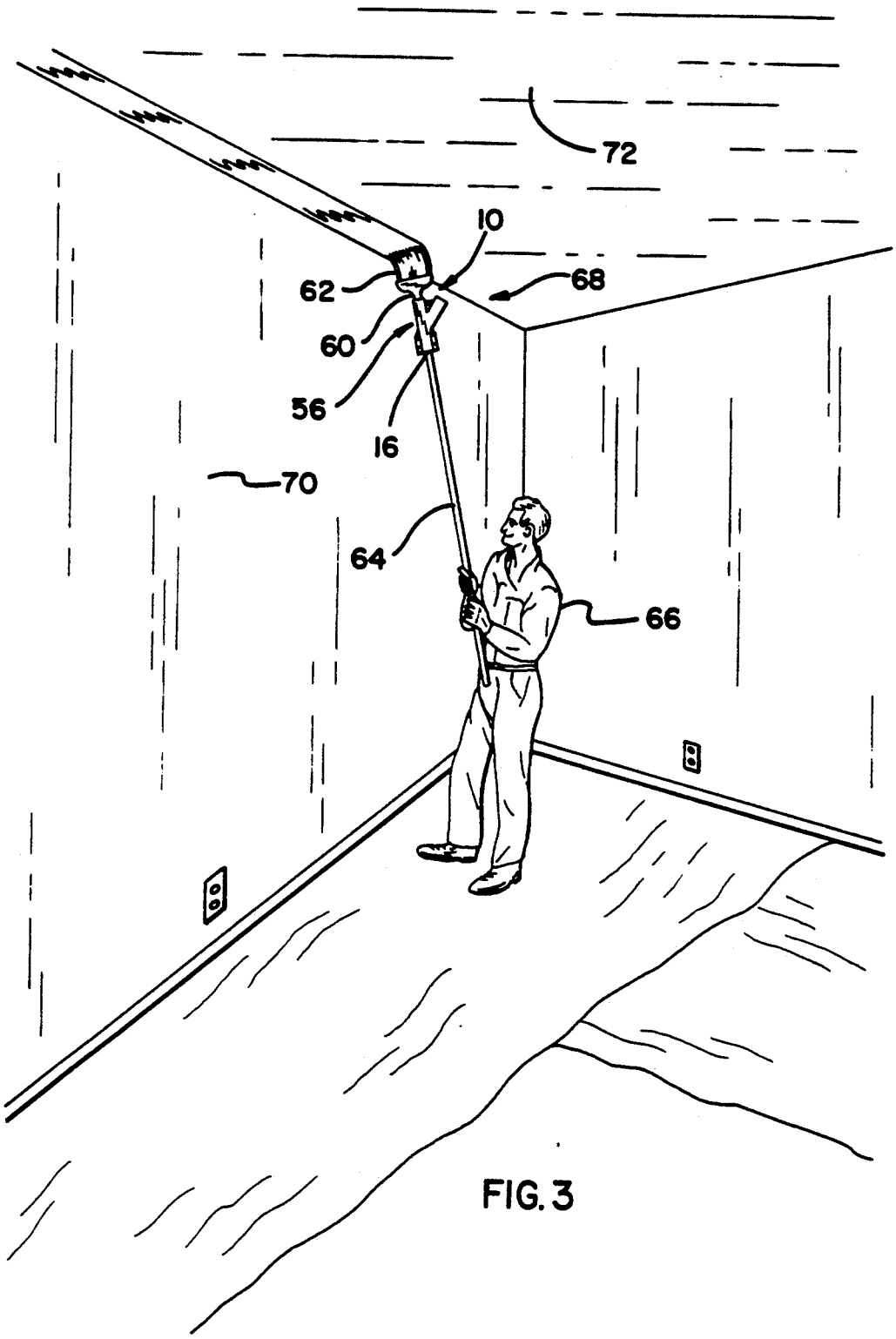
FIGS. 3 and 4 illustrate the use of the multiple angle paint brush holder of the present invention by a painter to paint the edge between a ceiling and a wall.
Figure 4:
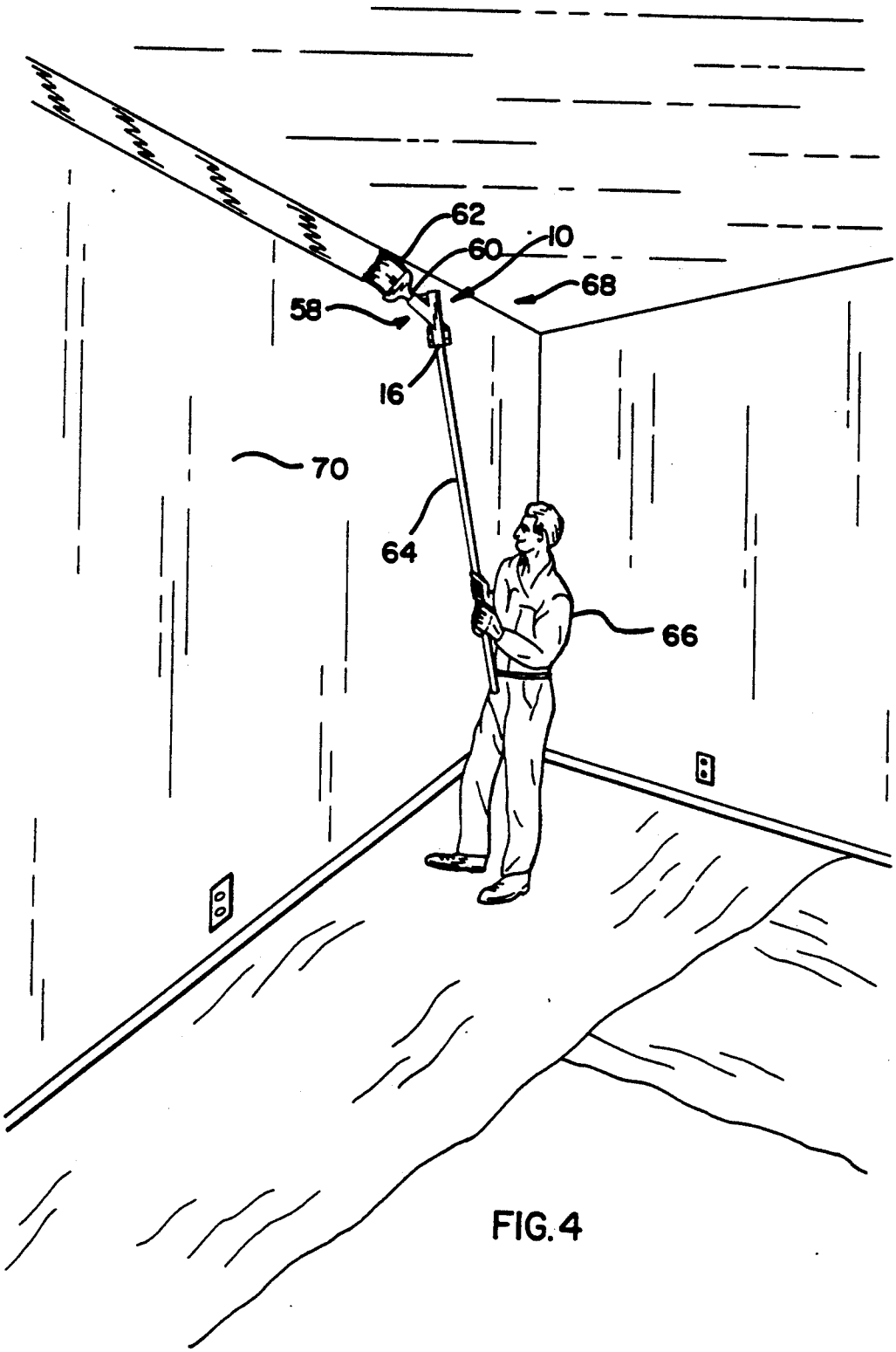

Reference is now made to FIGS. 3 and 4 to illustrate the use and benefits of the multiple angle paint brush holder 10. Paint rollers cannot be used to efficiently and effectively paint in a controlled manner the delicate, high, hard to reach painting places such as the wall 70 or ceiling 72 immediately adjacent to a high corner 68. With use of the holder 10 of the present invention, a paint brush may be used to paint this and other difficult painting locations without the need of a ladder.

The threaded cylindrical member 46 (FIGS. 1 and 2) at the first end 16 matingly receives a correspondingly threaded extension rod 64 to enable a painter 66 to reach the high, hard to reach painting location. With the handle 60 of a paint brush 62 inserted in the opening and retained by the first clamp 56 (as shown in FIG. 3), the multiple angle paint brush holder 10 enables the painter 66 to paint the ceiling 72 immediately adjacent the corner 68 without the use of a ladder. By then switching the handle 60 of the paint brush 62 to the second clamp 58 (as shown in FIG. 4), the multiple angle paint brush holder 10 enables the painter 66 to paint the wall 70 immediately adjacent the corner 68 also without the use of a ladder. Angling of the brush 62 in the manner shown allows the painter to use nearly the full width of the secured brush to effectively and safely paint the wall 70.

Although a preferred embodiment of the paint brush holder of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

I claim:

1. A painting tool, comprising:

means for receiving an extension means to reach a high, hard to reach painting location;

first means connected to the means for receiving for clamping onto a handle of a means for applying paint, the first means positioning the clamped means for applying paint at a first orientation parallel to and aligned with said means for receiving an extension means for painting the high, hard to reach painting location; and second means connected to the means for receiving for clamping onto a handle of a means for applying paint, the second means positioning the clamped means for applying paint at a second orientation for painting the high, hard to reach painting location, the second orientation angled away from the first orientation.

2. The painting tool as in claim 1 further including an extension means comprising an extension rod received within the means for receiving.

3. The painting tool as in claim 1 wherein the second orientation for the clamped means for applying paint is angled away from the first orientation by an acute angle.

4. The painting tool as in claim 3 wherein the acute angle is forty-five degrees.

5. A paint brush holder, comprising:

a cylindrical member having a first and second end, the first end having a bore extending therein, the bore threaded to matingly receive a correspondingly threaded extension rod;

opposed first and second mirror image members extending from the second end of the cylindrical member, each mirror image member having first and second channels defined therein, the first and second channels of the opposed mirror image members forming first and second openings at corresponding first and second orientations, respectively, angled away from each other for each receiving a handle of a paint brush, with said first orientation being parallel to and aligned with a received extension rod; and means for drawing the first member and the second member together, the opposed first and second channels each forming a means for clamping onto and securing a handle of a received paint brush.

6. The paint brush holder as in claim 5, wherein the first orientation and the second orientation are angled away from each other by a predetermined angle.

7. The paint brush holder as in claim 6 wherein the predetermined angle is an acute angle.

8. A paint brush holder, comprising:

first and second mirror image members each having a first end and a second end, each further having a first channel defined therein at the first end and a second and third channel defined therein at the second end;

means for securing the first mirror image member to the second mirror image member at the first end, the pair of mirrored first channels defining a first opening and the pairs of mirrored second and third channels defining second and third openings for each receiving a handle of a paint brush;

a separately insertable threaded means retained in the first opening for matingly receiving a correspondingly threaded extension rod; and means for drawing the first mirror image member to the second mirror image member at the second end, the pairs of mirrored second and third channels forming first and second means for clamping onto a handle of a paint brush received in either the second or third openings.

9. The paint brush holder as in claim 8 wherein the pair of mirrored second channels and the pair of mirrored third channels are angled away from each other by a predetermined angle.

10. The paint brush holder as in claim 9 wherein the predetermined angle is an acute angle.

11. The paint brush holder as in claim 8 wherein the pair of mirrored second channels are oriented to have the first means for clamping secure a handle of a paint brush parallel to and in alignment with a received extension rod.

* * * * *